US005176796A

United States Patent [19]

Irie et al.

[11] Patent Number: 5,176,796

[45] Date of Patent: Jan. 5, 1993

[54] AVOIDING PITCH TROUBLES USING ACYLGEROL LIPASE

[75] Inventors: Yuko Irie; Motoo Matsukura; Kunio Hata, all of Tokyo, Japan

[73] Assignee: Jujo Paper Co., Ltd., Tokyo, Japan

[21] Appl. No.: 684,516

[22] Filed: Apr. 15, 1991

Related U.S. Application Data

[63] Continuation-in-part of Ser. No. 449,008, Dec. 12, 1989, abandoned.

[30] Foreign Application Priority Data

Dec. 13, 1988 [JP] Japan ..... 63-314408

[51] Int. Cl.[5] ..... D21C 9/08; D21H 21/02

[52] U.S. Cl. ..... 162/174; 162/199; 162/DIG. 4; 435/134; 435/264; 435/278; 435/876; 435/917; 435/921; 210/632

[58] Field of Search ..... 435/134, 198, 264, 277, 435/278, 876, 874, 913, 917, 921; 162/174, 199, DIG. 4; 210/632

[56] References Cited

U.S. PATENT DOCUMENTS

| | | | |
|---|---|---|---|
| 2,280,307 | 4/1942 | Diehm | 435/278 |
| 3,189,529 | 6/1965 | Yamada | 435/198 |
| 4,327,183 | 4/1982 | Masuda et al. | 435/276 |
| 4,687,745 | 8/1987 | Farrell | 435/278 |
| 4,865,978 | 9/1989 | Serota | 435/198 |

FOREIGN PATENT DOCUMENTS

| | | | |
|---|---|---|---|
| 758488 | 5/1967 | Canada . | |
| 1375161 | 11/1974 | United Kingdom | 162/DIG. 4 |

*Primary Examiner*—W. Gary Jones
*Assistant Examiner*—Todd J. Burns
*Attorney, Agent, or Firm*—Sherman and Shalloway

[57] ABSTRACT

The method for avoiding pitch troubles includes the treatment with an acylglycerol lipase. The method of the present invention overcomes the pitch troubles in a process for the production of mechanical pulp and/or mechanical pulp-containing paper.

6 Claims, 2 Drawing Sheets

AVOIDING PITCH TROUBLES USING ACYLGEROL LIPASE

This application is a continuation-in-part of application Ser. No. 07/449,008, filed Dec. 12, 1989, now abandoned.

BACKGROUND OF THE INVENTION

1. Field of the Invention

The present invention relates to a method for controlling pitch troubles in a process for the production of mechanical pulp and/or of mechanical pulp-containing paper.

2. Prior Art

Mechanical pulp, such as groundwood pulp (hereinafter referred to as GP), refiner groundwood pulp and thermomechanical pulp is produced by the simplified mechanical treatment of grinding logs or chips by means of a grinder or refiner. The mechanical pulp, which has a defect of providing lower strength, exhibits advantages of providing higher yield, lower costs and higher opacity, compared with a chemical pulp produced by various chemicals such as alkaline chemicals. On the contrary, the wood constituents remain unchanged in the mechanical pulp. Mechanical pulp used in the present invention differs from SCP which is always produced by the digestion process for delignification. However, mechanical pulp does not include SCP. Further, the mechanical pulping process does not include a digestion process.

In general, a wood contains circa 1–10% of pitch, organic solvent-soluble extractive, besides three major constituents composed of cellulose, hemicellulose and lignin. The amount and quality of pitch vary with wood species. However, it is well-known that softwood, i.e. a main raw material of mechanical pulp, contains a large amount of pitch constituents such as fatty acids, resin acids, glycerides, etc. In the pulping process, these pitch-constituents are released from pulp, wherein they exist in state of liberation, deposition on fiber surface, and covering thereon. That is, they transform from a fixed state to a liberated state. Pitches suspended in reused water (white-water) are microparticles of about 0.2–2$\mu$, which are known as the so-called "colloidal pitch".

In general, a paper is manufactured as follows: Pulps are prepared in various pulping processes, are treated in a screening process, are mixed with different auxiliaries to prepare a paper furnish. A paper is made from the paper furnish on a paper machine. In a series of processes, the liberated pitch or the deposited pitch is accumulated in pipes, tanks, wire part, or press part, thereby causing the so-called pitch troubles, such as paper contaminations or paper brokes. In the production of a paper containing a large amount of mechanical pulp, pitch troubles occur frequently. As one of the conventional methods for controlling pitch troubles, there is the so-called seasoning, in which logs after felling are held outside and seasoned in a long period. As another method therefor, there is an addition of surface-active agent in a pulping or paper-making process, as demonstrated in Japanese Patent Publication No.50-22606, wherein the surface active agent includes, for example, alkylether of polyoxyethylene with various addition moles, alkyl phenyl derivatives, chemicals containing them as a main ingredient.

Although the above seasoning method causes the change and the decrease of pitch constituents in wood mainly by air-oxidation, it requires a broad area and a long period, for example, 3–6 months, or more. Accordingly, it is practically difficult to avoid the pitch troubles only by the above seasoning method.

On the other hand, the addition of surface active agent, which is said to disperse the pitch particles and to prevent the pitch deposits, is not recognized as a substantial method for controlling pitch troubles.

SUMMARY OF THE INVENTION

It is the object of the present invention to control pitch troubles in a process for the production of mechanical pulp or of mechanical pulp containing paper. The above object is achieved by treating a paper-stock and/or white-water with an acylglycerol lipase in a process for the production of mechanical pulp and/or of mechanical pulp-containing paper. The object and features of the present invention will become more apparent from the following description.

DETAILED DESCRIPTION OF THE INVENTION

Figure 1:
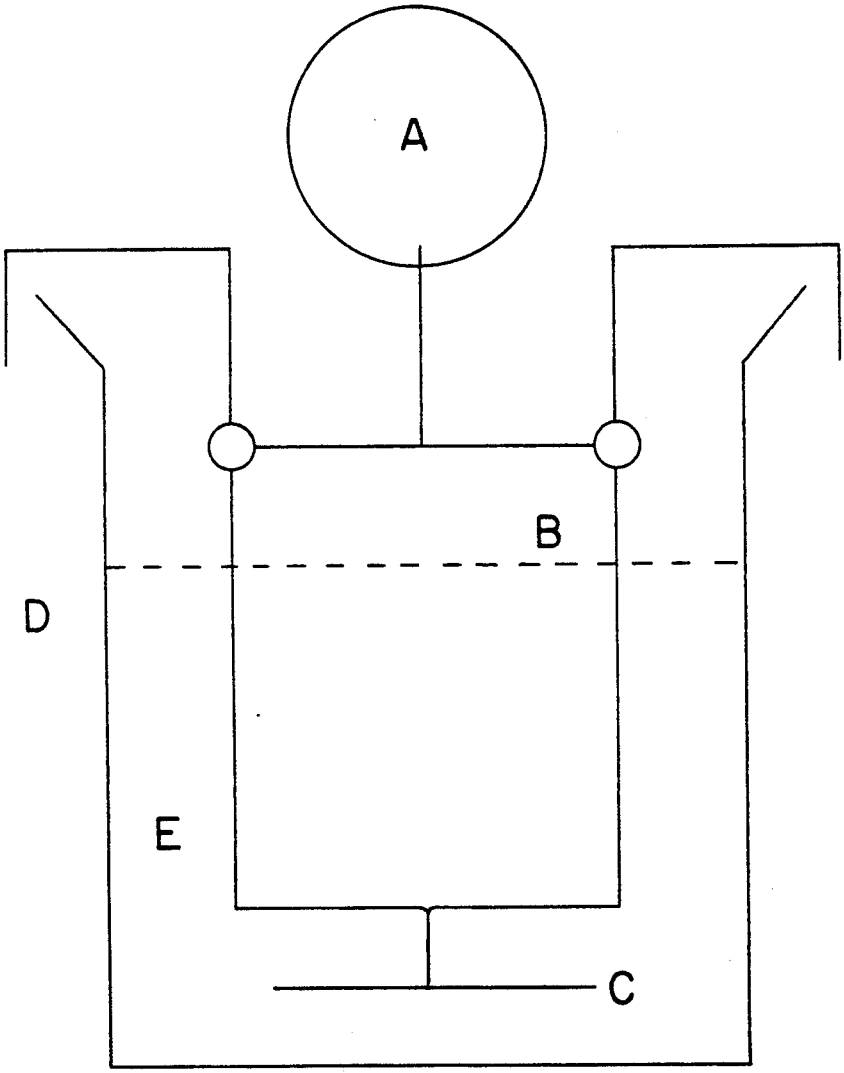
FIG. 1 is a cross-sectional view of an apparatus for measuring pitch deposits.

In order to obtain an effective method for controlling pitch troubles, the inventors have investigated in detail: (1) pitch constituents extracted from Japanese red pine (Pinus densiflora) as a typical pulpwood of mechanical pulp and (2) pitch constituents deposited in a process for the production of Japanese red pine-GP and/or of paper containing the pine-GP. As result, it has been found that the main constituents of the deposited pitch are the same as those contained in the original wood and consist mainly of triglycerides, fatty acids, resin acids and metal salts thereof. Further, it has been demonstrated that the deposited pitch contains always a large amount of triglycerides. It has been assumed that the triglyceride is responsible for one of the main constituents causing pitch troubles. From a point of view that the decomposition or removal of triglycerides by some method is effective for avoiding the pitch troubles, the inventors have investigated various chemical or biochemical methods.

As a result, the object of the present invention has been performed by using an acylglycerol lipase, wherein the triglyceride is decomposed and thus the pitch deposits do not occur without giving harm effects on the pulp or paper qualities and on the run-conditions. That is, the object of the present invention is performed by treating the paper-stock and/or reused water with an acylglycerol lipase in a process for the production of mechanical pulp and/or of mechanical pulp-containing paper. It is preferred that the acylglycerol lipase is that produced from at least one microorganism selected from the group consisting of Aspergillus niger, Pseudomonas fluorescens, Pseudomonas fragi, Geotrichum candidum, and Candida cylindracea.

The acylglycerol lipase of the present invention is an enzyme for hydrolyzing triglycerides, i.e. one of the main constituents of pitch, wherein any enzyme, if it hydrolyzes triglycerides, can be used.

Microorganisms for producing the enzyme of the present invention include, for example, *Aspergillus niger, Pseudomonas fluorescens, Pseudomonas fragi, Geotrichum candidum, Candida cylindricea, Mucor javanicus, Rhizopus javanicus, Rhizopus delemar, Rhizopus niveus*, fungi of genus Rhizopus and the like. Among these fungi, *Aspergillus niger, Pseucomonas fluorescens, Pseudomonas fragi, Geotrichum candidum* and *Candida cylindracea* are more effective.

The purer the acylglycerol lipase produced from the above microorganisms, the better the effect. Further, the acylglycerol lipases are used alone or in combination. And the good effect can be obtained, too, when the acylglycerol lipase of the present invention is used in combination with other decomposition-enzymes, such as cellulase, hemicellulase, pectinase, protease, etc.

In a process for production of mechanical pulp and/or of mechanical pulp-containing paper, the acylglycerol lipase of the present invention is added to a paper stock slurry, under agitation or standing. In this case, the enzyme of the present invention is added thereto in an amount of 0.1-10000 ppm (by weight), based on the weight of mechanical pulp, the temperature is preferably 10°-70° C., more preferably 35°-55° C. At less than 10° C., the enzyme functions weakly and slowly. At more than 70° C., the enzyme may become inactive. With the increased amount of the enzyme, the reaction is usually accelerated, wherein 10,000 ppm of the enzyme, based on the weight of mechanical pulp, is satisfactory, in the calculation from the amount of triglyceride as a substrate. The addition of more than 10,000 ppm of the enzyme is economically disadvantageous. The suitable pH-value is 3-11, and outside this range, the activity of the enzyme is decreased reasonably.

In a pulping or paper-making process, there is used a large amount of water of which the major portion is recycled and reused. Since the reused water (white water) contains the pitch constituents, the addition of the acylglycerol lipase to white water controls pitch troubles.

In this case, the superior effects are obtained by the direct addition of the above acylglycerol lipase into the white water, or by the addition of so-called immobilized acylglycerol lipase or of the so-called immobilized microorganism capable of producing acylglycerol lipase extracellularly, wherein the immobilization of the enzyme or microorganism is carried out by the conventional method, such as carrier-binding-, cross-linking-, entrapment method, etc.

Since the method of present invention causes a highly selective reaction known as an enzyme-reaction against triglyceride, and since this reaction is mild, the stock treated with the enzyme is not denatured so that the method of the present invention exerts no harm influence on the usual operation.

Pitch troubles occur in a complicated system comprising pulp fibers, pitches, metal ions, fillers, etc. Although the reason for causing pitch troubles is not perfectly known, it is said that the pitch troubles depend upon various factors, such as pitch consistency, pulp consistency, pH-value, temperature, metal-ion consistency, metal-ion kinds and the like. In general, an adsorption onto a solid surface is due to the exertion of Van der Waals force which fixes the substance adhered onto a solid surface.

As the mutual interaction between the substance and the solid, there are various types of actions, among which a hydrophobic bond, a reciprocal action of dipole moments, etc. are important. And a hydrophobic or non-polar molecule or a hydrophobic molecule-portion is easily attracted to a hydrophobic or non-polar surface, whereas a hydrophilic or polar molecule is easily attracted to a polar surface. Considering the mechanism for the pitch deposition in a pulp- or paper-making process, accordingly, tryglycerides play the following role. Through Van der Waals force, triglycerides, i,e. the non-polar constituent in colloidal pitch, adheres to the hydrophobic or non-polar surface, such as the metal surface of tank, pipe, etc.; the surface of the center roll of paper-making press section; and the like. The adhered portion exerts as a nucleus, to which the hydrophobic or non-polar molecules or the hydrophobic molecule-portions in pitch-constituents adhere successively to form the pitch deposits.

The mechanism for controlling the pitch depositions according to the present invention is as follows. The acylglycerol lipase exerts on the non-polar tryglyceride which exists in pulp surface-pitch or in colloidal pitch (such as pitch in white water) and which has high tackiness to the hydrophobic and non-polar surface, whereby triglyceride is hydrolyzed to water-soluble glycerol and polar fatty acid. Accordingly, the pitch depositions to hydrophobic surface of metal-pipes, chests, rolls, etc. are avoided. Since the pitch depositions are avoided in the early stage, the growth of the pitch deposits does not occur, which controls pitch troubles.

The method of present invention has an advantage of avoiding pitch troubles, such as pitch spots and holes in a paper-web, etc., caused by pitch deposited in a process for the production of mechanical pulp and of mechanical pulp containing paper. Further, the method of the present invention has no harm effect on the paper qualities and the practical run, it is simplified and applied to a conventional pulp- and paper making process without installing additional equipment.

The present invention will be understood more readily with reference to the following examples. However, these examples are intended to illustrate the present invention and are not to be construed to limit the scope of the present invention. Throughout the Examples, samples without enzyme treatment are shown as "control".

EXAMPLE 1

Fresh Japanese red pine chips were extracted with methanol, using a soxhlet extractor. 10 g of the obtained extracts were dissolved in a mixed solution of 100 ml isopropanol, 60 ml acetone and 5 ml water to obtain a pitch solution.

10 ml of the pitch solution were charged in a beaker containing 1 l of water and were dispersed under vigorous stirring to prepare a pitch dispersion. In such a manner, the resultant pitch was obtained in an yield of 4.7%, based on the weight of oven-dry chips, and it contained 37.8% triglycerides.

Then, the pH-value of the pitch dispersion was adjusted to 7 by adding hydrochloric acid and/or sodium hydroxide. The acylglycerol lipase was added thereto in different consistencies at various temperatures, as shown in Table 1, and was treated under gentle stirring for 4 hours to prepare a treated solution. In accordance with Tappi Routine Control Method RC 324, a cylinder built from polyethylene plate of 22 cm width and 7 cm length is setted 2.5 cm above the water level. The adjusted solution was stirred for 30 minutes by using a Vibromixer (Linitator, manufactured by U.S. Heidon Co.)

Polyethylene-cylindrical plate was taken out and dried. The weight of the deposited pitch and the percentage to untreated pulp were indicated in Table 1.

TABLE 1

| Enzyme Kind | Enzyme Concentration[4] | Temperature 20° C. | 40° C. | 60° C. |
|---|---|---|---|---|
| Control | — | 115 mg (100%) | 102 mg (100%) | 117 mg (100%) |
| | 50 ppm | | 93 mg (80.9%) | |
| Li. OF[1] | 500 ppm | 58 mg (50.4%) | 35 mg (30.4%) | 90 mg (78.3%) |
| | 1000 ppm | | 28 mg (24.3%) | |
| Li. A[2] | 500 ppm | 66 mg (57.4%) | 54 mg (47.0%) | 96 mg (83.5%) |
| Li. P[3] | 500 ppm | 67 mg (58.3%) | 60 mg (52.2%) | 83 mg (72.7%) |

Note
[1]Li.OF: trade name = Lipase OF (manufactured by Meitosangyo Co.), produced from Candida cylindracea.
[2]Li.A: trade name = Lipase A (manufactured by Amano Seiyaku Co.), produced from Aspergillus niger.
[3]Li.P: trade name = Lipase P (manufactured by Amano Seiyaku Co.), produced from Pseudomonas fluorescens.
[4]Concentation = Concentration of enzyme addition, based on pitch.

EXAMPLE 2

The pH-value of the pitch dispersion was adjusted to 7 with hydrochloric acid and/or sodium hydroxide. The acylglycerol lipase was added thereto in an amount of 500 ppm, based on the weight of pitch, and was stirred at 40° C. After a certain time, the amount of deposited pitch was obtained in the same manner as in Example 1 and was indicated in Table 2.

TABLE 2

| Enzyme Kind | Enzyme Concentration | Temperature 2 hours | 4 hours | 6 hours |
|---|---|---|---|---|
| Control | — | 105 mg (100%) | 101 mg (100%) | 107 mg (100%) |
| Li. OF | 500 ppm | 67 mg (63.8%) | 31 mg (30.7%) | 31 mg (24.4%) |
| Li. GC-[5] | 500 ppm | 85 mg (81.0%) | 70 mg (69.3%) | 59 mg (55.1%) |

Note
[5]Li. GC-5: trade name: Lipase GC-5 (manufactured by Amano Seiyaku Co.), produced from Geotrichum candidum.

EXAMPLE 3

1 l of a slurry containing 10 g GP of 63 ml CSF(Canadian Standard Freeness) was prepared from Japanese red pine.

The acylglycerol lipases were added thereto in various consistencies and was treated under different pH-values in the same manner as in Example 1.

The amount of pitch deposited to polyethylene-cylindrical plate was measured as shown in Example 1, and was indicated in Table 3.

TABLE 3

| Enzyme Kind | Enzyme Concentration[7] | pH 3 | 5 | 7 | 9 |
|---|---|---|---|---|---|
| Control | — | 118 mg (100%) | 112 mg (100%) | 102 mg (100%) | 121 mg (100%) |

TABLE 3-continued

| Enzyme Kind | Enzyme Concentration[7] | pH 3 | 5 | 7 | 9 |
|---|---|---|---|---|---|
| Li. OF | 10 pp | — | — | 90 mg (88.2%) | — |
| | 50 ppm | 80 mg (67.8%) | 58 mg (51.8%) | 28 mg (27.5%) | 62 mg (51.2%) |
| | 250 ppm | — | — | 21 mg (20.6%) | — |
| Li. B[6] | 10 ppm | — | — | — | 96 mg (79.3%) |
| | 50 ppm | 95 mg (80.5%) | 65 mg (58.3%) | 42 mg (41.2%) | 27 mg (22.3%) |
| | 250 ppm | — | — | — | 24 mg (19.8%) |
| Li. A | 50 ppm | 84 mg (71.2%) | 66 mg (58.9) | 49 mg (48.0%) | 88 mg (72.7%) |

(40° C., Treating period = 4 hours)
Note
[6]Li. B: trade name = Lipase B (manufactured by SAPPORO BREWERIES LIMITED), produced fro Pseudomonas fragi 22-39 B.
[7]Concentration = Concentration of enzyme addition, based on the weight of pulp.

EXAMPLE 4

The same sample as in Example 3 was used. The enzyme of the present invention was added to the sample in an amount of 50 ppm, based on the weight of pitch, and was treated in the same manner as in Example 1, at different temperatures and times. The amount of deposited pitch was measured and indicated in Table 4.

TABLE 4

| Enzyme Kind | Enzyme pH | Treating period | Temperature 20° C. | 40° C. | 60° C. |
|---|---|---|---|---|---|
| Control | 7 | — | 115 mg (100%) | 102 mg (100%) | 117 mg (100%) |
| Li. OF | | 2 hours | — | 44 mg (53.9%) | — |
| | | 4 hours | 64 mg (55.7%) | 29 mg (28.4%) | 100 mg (85.5%) |
| | | 8 hours | — | 27 mg (26.5%) | — |
| Control | 9 | — | 128 mg (100%) | 121 mg (100%) | 134 mg (100%) |
| Li.B | | 2 hours | — | — | 43 mg (32.3%) |
| | | 4 hours | 97 mg (75.8%) | 27 mg (22.3%) | 26 mg (19.4%) |
| | | 8 hours | — | — | 25 mg (18.7%) |

EXAMPLE 5

1% pulp slurry consisting of 20% of waste newspaper pulp (105 ml CSF), 25% of GP (63 ml CSF), 25% of thermomechanical pulp (107 ml CSF) and 30% of kraft pulp was prepared. 1 l of this pulp slurry was used as a sample. The enzyme of the present invention was added thereto in an amount of 50 ppm, based on the weight of pulp, treated at 40° C. for 4 hours, stirred for 120 minutes by a Vibromixer equipped with polyethylene cylindrical plate. The amount of deposited pitch was measured and indicated in Table 5.

TABLE 5

| | Amount of deposited pitch |
|---|---|
| Control | 65 mg (100%) |

TABLE 5-continued

| | Amount of deposited pitch |
|---|---|
| Lipase OF | 18 mg (27.7%) |

EXAMPLE 6

3 l of white water obtained by filtering Japanese red pine GP in a screening-stage were used as a sample. The enzyme of the present invention was added to the sample in an amount of 0.5 ppm, based on the weight of the white water, treated at 40° C. for 2 hours, and stirred with a vibromixer for 120 minutes. The amount of pitch deposited to polyethylene cylindrical plate was measured and indicated in Table 6.

TABLE 6

| | Amount of deposited pitch |
|---|---|
| Control | 37 mg (100%) |
| Li.OF | 7 mg (18.9%) |

EXAMPLE 7

A newsprint paper of circa 46 g/m$^2$ base weight was made by means of a Bel-Baie former multi-dryer paper machine with 5080 mm width and 830 m/min speed, wherein the paper stock consists of 30% GP, 45% waste newspaper pulp (deinked), 10% softwood KP and 15% thermomechanical pulp.

In this case, GP was prepared from red pine, and was adjusted to a freeness of 60 70 ml CSF by the post refining, stored as a stock-pulp for a while, optionally mixed with other pulps and auxiliaries, again stored and then fed to a paper-making process. It takes 90 minutes from the post refiner through chests, tanks to the paper making machine. The enzyme of the present invention was added to the GP slurry of 3.8% consistency before the post refiner so that Lipase OF has a concentration of 3 ppm. The enzyme was continuously added to GP for two weeks.

There were determined the amounts of pitch deposited at the wire and press parts, and the interval between the removals of pitch deposited onto the center roll. The practical output of the paper machine was about 270 tons per day. The removal of pitch deposited on the center roll aims at preventing the excess pitch deposition for the good run, and the interval between the removals of pitch deposited onto the center roll is shortened with the increased amount of pitch deposits. The obtained results were compared with those of "control", and were indicated in Table 7.

TABLE 7

| | | Control | Li OF |
|---|---|---|---|
| Amount of pitch Deposited (g/day) | Max | 895 | 89 |
| | Min | 73 | 0 |
| | Average | 207 | 43 |
| Interval between the removals of pitch deposited (minutes) | Max | 120 | 240 |
| | Min | 30 | 120 |
| | Average | 80 | 170 |

EXAMPLE 8

A light-weight printing paper of 34 g/m$^2$ base weight was produced in accordance with Example 7, wherein the paper-stock consists of 20% GP, 50% waste newspaper pulp (deinked), 15% softwood KP and 15% thermomechanical pulp. Lipase OF was added to GP slurry in an amount of 3 ppm. The practical output of the paper machine was about 200 tons per day. For the comparison with the results of "Control", there were determined the amount of pitch deposited in the wire and press parts, and the pitch holes of the paper due to pitch deposition at the breaker stack. The results were indicated in Table 8.

TABLE 8

| | | Control | Li OF |
|---|---|---|---|
| Amount of pitch deposited (g/day) | Max | 590 | 98 |
| | Min | 132 | 15 |
| | Average | 221 | 47 |
| Number of pitch holes* (per day) | Max | 65 | 14 |
| | Min | 13 | 0 |
| | Average | 38 | 6 |

*Expressed by number of small paper slips peeled off in the breaker stack.

EXAMPLE 9

Chip, groundwood pulp, bleached sulfite pulp, bleached sulfate pulp, and bleached-SCP were prepared from red pine, and then treated in the same manner as described in Example 1.

In each of the above pulps, the amount of pitch deposited on a polyethylene cylinder was measured as in Example 1, and the results are indicated in the following Table 9. The addition of lipase was found to unexpectedly decrease markedly the amount of pitch deposited.

TABLE 9

| Pulp type | Resinous materials (%) | Triglycerides (%) | Amount of pitch deposited (mg.) Before lipase addition | After lipase addition |
|---|---|---|---|---|
| Chip | 4.0–6.0 | 2.0–3.0 | — | — |
| Groundwood pulp | 3.5–5.5 | 1.5–2.6 | 52 | 4 |
| Bleached sulfite pulp | 0.2–0.5 | Trace | Trace | Trace |
| Bleached sulfate pulp | 0.1–0.2 | ND | Trace | Trace |
| Bleached SCP | 0.3–0.6 | Trace | 1.5 | 1.5 |

(Note)
ND: Not Detect

As seen above, the pitch content of SCP is decreased to less than one-tenth of the pitch content of a mechanical pulp due to the digestion with the chemicals utilized in the SCP-pulping process. In a mechanical pulp, however, the amount of the pitch deposited is dramatically decreased by the addition of lipase. That is, lipase has advantageous effects on a mechanical pulp. Thus, the effects in the addition of lipase to a mechanical pulp are not anticipated. The following known methods are used to measure "pitch" which adversely effects papermaking processes.

1. Method of Measuring Total Pitch

The purpose of this method is to measure the total amount of wood resin present. The pulp, chips of wood or deposited pitch are extracted with a solvent, such as alcohol-benzene or acetone in a Soxhlet extractor. The residue is weighted after the removal of the solvent.

2. Method of Measuring Deposited Pitch

This method consists of agitating a pulp suspension for several hours with various types of wire or felt, and then weighing the deposited resin thereon.

3. Method of Measuring the Colloidal Pitch

As proposed by L. H. Allen, this method counts the colloidal particles in hemacytometer with a microscope.

The method used in measuring pitch in the experiments herein was designed with a slight modification of method No. 2 above. First, water or pulp slurry is prepared by mixing the resinous materials extracted from Akamatsu (Japanese red pine). Second, the slurry is vibrated up and down with a polyethylene cylinder. The pitch deposited on the polyethylene cylinder is determined by the difference in weight. The effect of lipase treatment was estimated by this method.

The Experimental method for pitch measurement is illustrated below.

1. Preparation of Pitch methanol extracts from Akamatsu wood was fractionated into polar and non-polar compounds by XAD-2 resin (refer to FRACTIONATION METHOD OF RESINOUS MATERIALS IN WOOD). 10 g of polar or non-polar compounds was dissolved in 165 ml of the solvent (isopropyl alcohol:acetone:-water=100:60:5), respectively.

2. Deposition Test 10 ml of the above pitch solution (ca. 0.6 g solid pitch) was added into 1000 ml of water or GP slurry (1% slurry of GP produced in Ishinomaki mill). The PH of the slurry was adjusted to 7.0 by 0.1N-NaOH solution, and then 6 ml of 10% aluminum sulfate solution was added. A one-liter glass beaker which was equipped with polyethylene cylinder and the agitator as shown in FIG. 1, was employed for the deposition test by the following conditions:

Temperature: 20° C.
pH: 4.0
Time: 20 min

Agitation by Linitator: 500 times/min (up and down) After 20 min., the polyethylene cylinder was removed and dried at 105° C. for 1 hour. The amount of pitch deposited was calculated by weighing. Besides measuring the weight, the color of deposited pitch was observed. The polyethylene cylinder was dried and soaked in the dye solution at 60° C. The solution consists of 0.1% of Diacryl Red GTL-N, VRGTN produced by Mitsubishi Kasei Co., Ltd.

In FIG. 1 A: Agitator
(Linitator Type33E by HEIDON CO.)
B: Polyethylene Cylinder
circumference 22 cm
height 7 cm
This cylinder was set above 2.5 cm from water level
C: Circle disk
(Diameter 8 cm)
D: Beach (1 )
E: Sample (pulp slurry)

The effect of pitch-control agents on deposition was also measured. Each of three pitch-control agents was mixed with GP slurry. The deposition test was then conducted for each of three mixed samples. Addition rates for each sample were the same as those in a mill. The amount of each pitch-control agent tested is as follows:

| | |
|---|---|
| High-Touch (nonionic surfactant) | 500 ppm |
| Bentonite (retention aids) | 0.5% |
| Mistron Vapor (fine talc) | 3.0% |

Figure 2:
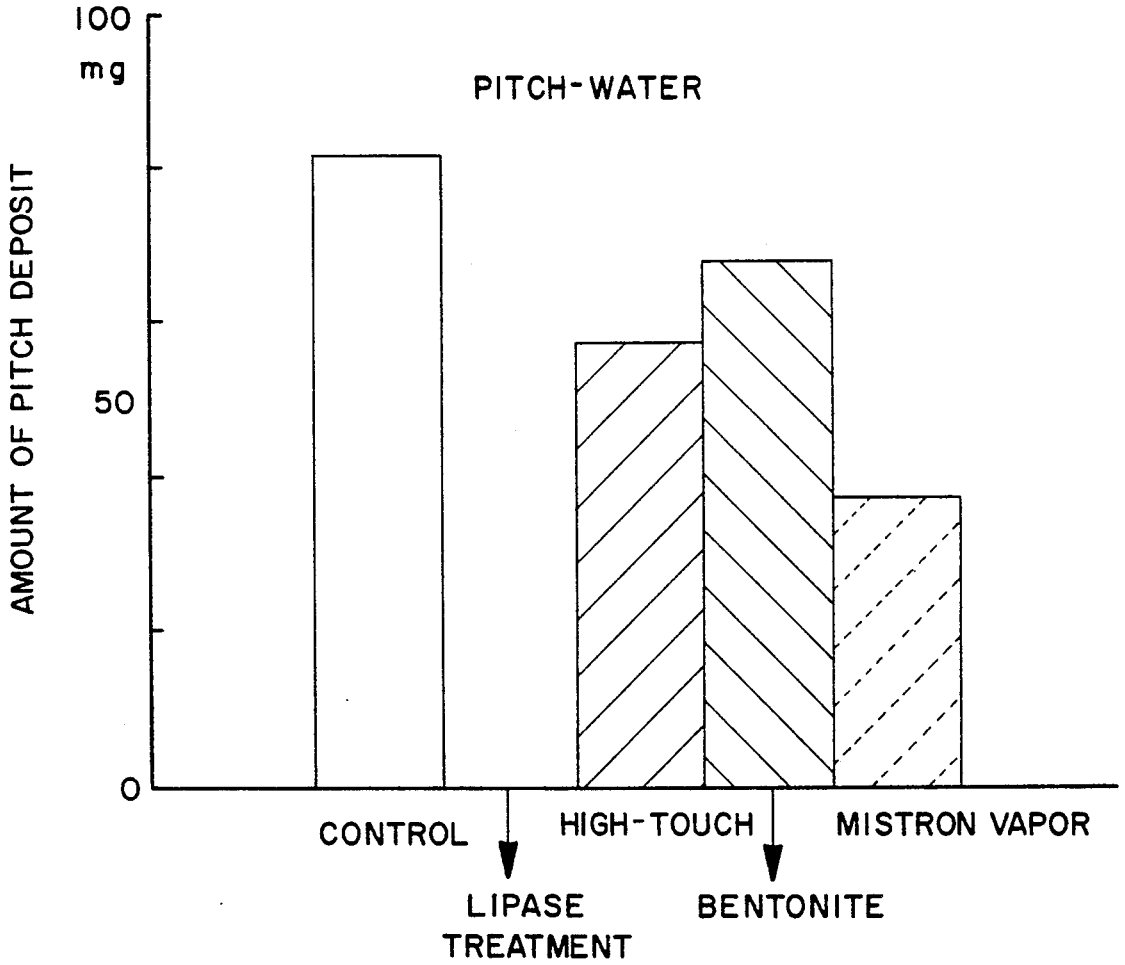
FIG. 2 is a bar graph showing the effect pitch-control agents on pitch deposition.

The results of these tests is shown in Table 10 below, and in FIG. 2. It can be seen from FIG. 2 that the addition of lipase results is an unexpected drop in the amount of pitch deposited.

TABLE 10

Effect of other pitch-control agents on pitch deposition

| | Control | Lipase treatment | High-touch | Bentonite | Histron vapor |
|---|---|---|---|---|---|
| Amount of pitch deposit | 81 mg | trace | 57 mg | 67 mg | 37 mg |

pH of pulp slurry was adjust to 4.0 by HCl
(Pitch solution: polar:nonpolar 8:2)

We claim:

1. A method for controlling pitch troubles in a process for the production of mechanical pulp or mechanical pulp-containing paper, which consists essentially of treating at least one member selected from the group consisting of paper-stock and reused water by the addition of lipase, wherein the pH-value of said paper-stock and said reused water ranges from 3 to 11.

2. The method according to claim 1, wherein said lipase is that produced from at least one microorganism selected from the group consisting of *Aspergillus niger, Pseudomonas fluorescens, Pseudomonas fragi, Geotrichum candidum* and *Candida cylindracea.*

3. The method according to claim 1, wherein said lipase added to paper-stock slurry in an amount of 0.1–10,000 ppm, based on the weight of mechanical pulp.

4. The method according to claim 1, wherein the temperature of said at least one member selected from the group consisting of said paper-stock and said reused water ranges from 10° C. to 70° C.

5. The method according to claim 1, wherein the temperature of said at least one member selected from the group consisting of said paper-stock and said reused water ranges from 35° to 55° C.

6. The method according to claim 1, wherein the pH-value of said at least one member selected from the group consisting of said paper-stock and said reused water ranges from 3 to 11.

* * * * *